United States Patent [19]

O'Brien, deceased et al.

[11] 4,115,188

[45] Sep. 19, 1978

[54] METHOD FOR RECYCLING PAPER MILL WASTE WATER

[76] Inventors: Richard C. O'Brien, deceased, late of Dayton, Ohio; by Elva R. O'Brien, executrix, 983 Patrilt Sq., Dayton, Ohio 45459

[21] Appl. No.: 696,940

[22] Filed: Nov. 8, 1976

Related U.S. Application Data

[63] Continuation-in-part of Ser. No. 612,567, Sep. 11, 1975, abandoned.

[51] Int. Cl.[2] ..... D21F 1/66

[52] U.S. Cl. ..... 162/190; 162/191; 210/53

[58] Field of Search ..... 162/189, 190, 191, 29, 162/337; 210/52, 53, 196, 199

[56] References Cited

U.S. PATENT DOCUMENTS

| | | | |
|---|---|---|---|
| 1,968,114 | 7/1934 | Windecker | 210/53 |
| 1,980,896 | 11/1934 | Windecker | 210/53 |
| 2,057,059 | 10/1936 | Rue | 162/190 |
| 2,074,082 | 3/1937 | Domogalla | 210/53 |
| 3,235,444 | 2/1966 | Kruger | 162/190 |
| 3,354,028 | 11/1967 | Illingsworth | 162/189 |
| 3,575,853 | 4/1971 | Gaugham et al. | 210/196 |
| 3,639,206 | 2/1972 | Spruill | 162/190 |

OTHER PUBLICATIONS

"Screening of Effluents," Fuller, Tappi, vol. 56, No. 6, Jun. 1973, pp. 104–106.

*Primary Examiner*—Richard V. Fisher
*Assistant Examiner*—Peter F. Kratz
*Attorney, Agent, or Firm*—Biebel, French & Nauman

[57] ABSTRACT

Disclosed is a method for coagulating the suspended solids in paper mill waste water so that the coagulated solids may be easily separated from the waste water and the clarified waste water reused in the paper making process. Coagulation is induced by first adding sulfuric acid to lower the pH to below 4, mixing thoroughly, and then adding calcium hydroxide to raise the pH to above 10. The coagulated solids separated from the waste water may be used as a landfill, used as a low grade pulp source, or dewatered and burned as a fuel.

10 Claims, 1 Drawing Figure

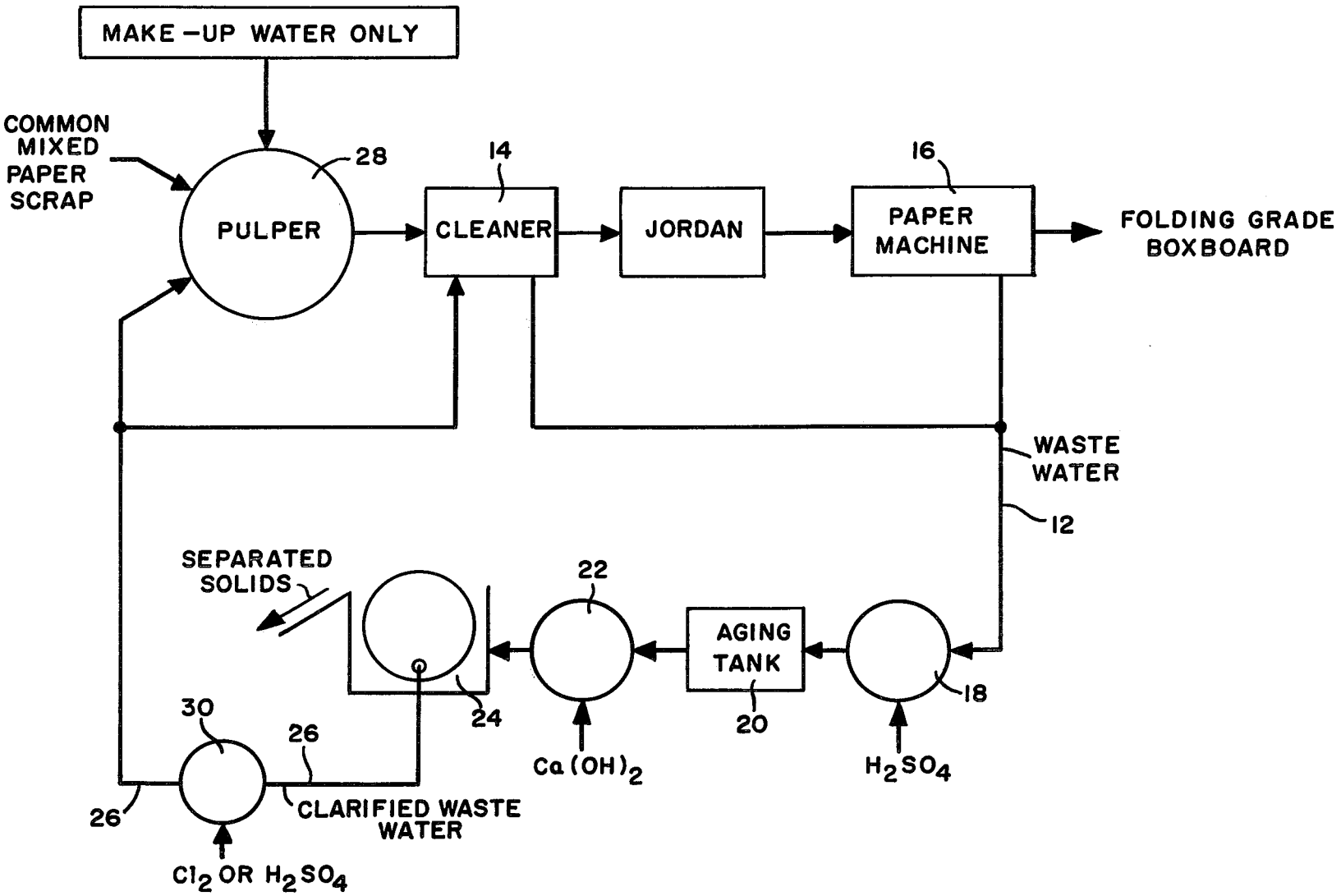
MAKE-UP WATER ONLY
COMMON MIXED PAPER SCRAP
PULPER
28
CLEANER
14
JORDAN
PAPER MACHINE
16
FOLDING GRADE BOXBOARD
WASTE WATER
12
18
$H_2SO_4$
AGING TANK
20
22
$Ca(OH)_2$
24
SEPARATED SOLIDS
CLARIFIED WASTE WATER
26
30
$Cl_2$ OR $H_2SO_4$
26

METHOD FOR RECYCLING PAPER MILL WASTE WATER

CROSS REFERENCE TO RELATED APPLICATIONS

This is a continuation-in-part of application Ser. No. 612,567, filed Sept. 11, 1975 now abandoned.

BACKGROUND OF THE INVENTION

This invention relates to a process for treating paper mill waste water and, more particularly, to a method of coagulating the suspended material in paper mill waste water so that it may be easily removed therefrom and the clarified water reused in the paper making process.

For years paper mills of all types, both primary and secondary mills, have faced serious problems in obtaining an adequate supply of fresh water and in disposal of the waste water effluents. Historically paper mills have taken huge amounts of water from local supplies, used the water in various segments of the paper making process, combined the waste water from these operations, and then discharged the effluents into nearby lakes, streams and rivers. For that reason, the Environmental Protection Agency has recently issued effluent guidelines and standards for the pulp, paper and paperboard point source category (39 FR 18742, May 29, 1974).

While means are known for treatment of paper mill waste water to bring the effluents in line with the EPA specifications, these involve primary, secondary and tertiary treatments which are time consuming, costly and for the most part impractical. As stated in Gavelin, *Fourdrinier Papermaking,* Lockwood Trade Journal Co., New York, New York, 1963, at page 27:

> "The load of fiber, filler and dissolved organic material in the effluents remains a surprisingly acute problem in most paper mills. It is surprising because with modern technology it would seem a trivial matter to clean water, at least to the extent of removing suspended material. The explanation to the mystery is the need for economy." The economic consideration in the water flow of a paper mills also involves the need for procuring additional fresh water to the extent that waste water cannot be economically treated and reused.

In primary and secondary paper mills the need for useable water is considerable. The fresh water needs and effluent problems vary somewhat depending on the type of paper making operation, but all paper mills have need for an economical process for treating and recycling waste water.

Primary mills may be defined as those operations that more or less continuously make paper from pulp produced at the mill itself. In the unbleached kraft process, for example, the water used to wash the pulp after the cooking operation is returned to the recovery loop for the pulping process as black liquor. This black liquor is concentrated and burned to recover the dissolved salts.

The washed pulp which then goes to the paper making process still contains considerable dissolved lignin together with other organic color bodies. Fresh water used in dilution, refining, and other processes picks up the dissolved lignin, sizing, fines, etc. in passing through the system. The resultant waste water is a dark brown murky fluid, smelling of mercaptans and other odoriferous chemicals from the pulping process.

Secondary mills are defined as those operations that make paper, boxboard, roofing paper and the like, as the result of procuring the raw materials elsewhere, i.e., virgin pulp, reclaimed pulp, waste paper, etc.

For example, in a boxboard mill the product consists of several layers of paper laminated together. The outer layers are usually white and the inner layers are usually darker. The pulp requirements for the various layers differ.

The top liner sheet is usually white and may be made from bleached virgin pulp or produced by repulping white waste cuttings. The water requirements for this layer in the bulking, refining and dilution steps are that the water be substantially clear of suspended solids and emulsions and be substantially colorless.

The under liner and back liner are usually of less quality and the water requirements are less stringent than the top liner. In practice the effluent from the top liner section is used as the supply for these laminae. Additionally, the pulp requirements for these laminea are less and are typically obtained by repulping and deinking newspapers, magazines, etc.

The filler sections require an even less quality water and pulp. The water supply usually comes from the under liner and back liner sections. The pulp is often derived from repulping and cleaning common mixed paper waste.

The water used in the various pulpings, refinings, deinkings, cleanings, and dilutions, becomes contaminated with a number of substances. Among these are: starches, caseins, ink particles, carbon particles, clay, resins, fines (small cellulose fibers), and emulsifying agents. The result is a waste water that has a slow settling portion, suspended solids, dissolved solids, and is generally murky and foul smelling. As such it is unsuitable to be reused in the paper making process.

Attempts have been made to clarify the settleable fraction and recirculate some of the water obtained from the clarification process back to the liner sections. This has resulted in lowering the strength of the board. Furthermore, it is insufficiently clean and clear to use in the top, back and under liner sections. In addition, the waste water cannot be readily filtered since the various components (gels, etc.) quickly "blind" a filter. Therefore, a relatively coarse screen is used resulting in the passage of a substantial amount of fines which in turn reduces the overall strength of the board. In cases where this method has been used, increasing the caliper of the board has been necessary to compensate for the reduced lamina strength.

Chemical treatments have also been used in conjunction with centrifuging, filtering, sedimentation, etc., in an attempt to clarify paper mill waste water. These include the use of alum, lime, and organic polyelectrolyte flocculating agents. One such process in use at the Sterling Operation of Brown Company adds activated silica, alum and sulfuric acid to the waste water prior to its entering the clarifier. The chemical additives are said to provide floc formations and enhance the coagulation and settleability of the solids to the bottom of the clarifier. The clarified water is then released into a river while the sludge is pumped to a filter house where polymers are added to assist in the removal of water from the sludge.

The patent literature reveals that a number of such systems have been proposed for clarification of industrial waste effluents of various types. For example, Chappell in U.S. Pat. No. 3,812,032, discloses a system for treating domestic, municipal and industrial liquid wastes to reduce the BOD of the effluent. The Chappell process involves using an acid solution to adjust the pH to about 0 to 4 and an alkaline formula to adjust the pH to about 9–14. However, the only disclosed embodiment for the use of the acid and alkaline formulas is to separate the waste water into two portions. The first portion is treated with the acid formula and the second portion is treated with the alkaline formula, and then the two are mixed. Despite Chappell's asserted success with this order of addition of chemcial formulas, it has been found that in treating paper mill waste water such an arrangement does not result in good floc formation and clarification sufficient for recycling the water.

Other patents also suggest using acid and alkaline formulas but with different orders of additions. For example, in U. S. Pat. No. 3,314, 880 to Rubin there is disclosed a method of purifying waste water containing proteinaceous substances by adding an acid to give the liquid a pH value of 4 – 4.5 followed by addition of a basic substance. This addition of chemicals is done during a flotation process during which other precipitants are also added.

Likewise, in U.S. Pat. No. 3,354,028 to Illingsworth there is disclosed a method of clarifying the effluent from a waste paper deinking plant by chemically reversing the pH on addition, in either order, of alum and an alkali or alkaline earth metal hypochlorite. In the acidification phase, the pH is lowered to 4.0 – 6.5 and in the basic phase the pH is raised to 6.5 – 7.5.

British Pat. No. 1,032,725 also discloses a system using an acid formula and an alkaline formula in the treatment of industrial sewage. Here, ferrous sulfate in the form of a 5–25% solution in dilute hydrochloric acid (pH 1 – 2.5) is added, supplemented by a sufficient amount of sodium hydroxide to obtain a pH value in the liquid to be clarified in the range of 7.5 – 9.0.

Similarly, Gaughan in U.S. Pat. No. 3,575,853 discloses a process of removing multivalent metal ions from waste water by adding acid, passing the acidified aqueous medium through a bed of metal particles, and then raising the pH with an alkaline material. The acid step lowers the pH to from 1 to 5 and the addition of alkaline material raises the pH from 7 to 10.

It has been found that the problem with these procedures is that unless the pH is lowered to below 4, there be thorough mixing, and then the pH raised to above 10, the process is not effective to clarify paper mill waste water sufficiently to permit its reuse in the paper making process.

Accordingly, there remains a need for an effective, low-cost process for treating paper mill waste water to clarify it adequately for reuse in the paper making process.

SUMMARY OF THE INVENTION

The present invention fills this need by providing a feasible method for coagulating the suspended material in paper mill waste water so that the coagulated solids can be easily separated from the waste water and the clarified water recycled to the input water line for the various paper-making steps. Unlike the above mentioned prior art processes, it is proposed to do this by using an acid to drive the pH of the waste water to below 4, mixing thoroughly, and, then, driving the pH of the acidified waste water far in the opposite direction, i.e., to a pH of over 10.

The acid preferred is sulfuric acid. The alkaline material preferred is calcium hydroxide (slaked lime). While other acid and alkaline materials may be used, those designated have proved superior for the treatment of paper mill waste water in terms of their low cost, ready availability, acceptability to the paper industry, and ability when used in the manner described to cause good coagulation of the suspended solids in the waste water. Acids and alkaline materials having equivalent characteristics may be substituted for those preferred. The sulfuric acid must be added first. Of course, the need to add acid is based on the assumption that the waste water does not already have a pH of below 4, which is usually the case for paper mill waste water (typically waste waters of the type to be treated have a near neutral pH).

Optionally, the acidified waste water may be aged for a sufficient period of time to render insoluble some of the dissolved and emulsified solids. The amount of time for aging, should it be desired, varies depending upon the temperature, but satisfactory results have been obtained by aging for approximately five minutes at temperatures of between 100°–110° F. This "aging" may also take place during the mixing step should thorough mixing require any substantial amount of time. In one embodiment, a separation step can take place after such aging.

However, as the preferred embodiment aging is followed by addition of the alkaline material to the acidified, aged waste water. Preferably a dry slaked lime is used. The lime is thoroughly and quickly blended with the waste wateracid mixture to rapidly raise the pH to 10.0 or higher. Floc formation at this level takes place almost immediately and with very little residence time the coagulated solids are ready for separation.

Separation may be by any of a number of means such as filtration, decantation, sedimentation, etc. Preferable are such filtration techniques as use of a rotary vacuum filter.

The clarified waste water is then treated with additional acid to return the clarified waste water to a substantially neutral pH. In this condition, the clarified water may be reintroduced into the paper making process at any of the various points where fresh water is used. However, while the addition of further acid to neutralize the clarified water usually removes any color present, in some instances it has been found that the waste water even after treatment may have a light transparent yellow color. This might be considered objectionable if the clarified water were to be used in the headbox of a bleached paper making process. While tests have indicated that the yellow color would probably not taint the bleached paper pulp, chlorine could be used in addition to or even in place of an acid to both neutralize the clarified water and form an oxidant which removes the yellow color.

The separated solid waste can be disposed of in several ways: (1) used as a landfill, (2) reused in the paper making process itself; for example, in a filler section of boxboard, or (3) burned. In order to burn the solids (sludge), the water must be further evaporated. This can be done in a kiln, fluidized bed, or other means of dewatering sludges. In this manner the dewatered sludge may be used as a source of fuel for the power plant of the paper mill.

Thus, a total reclamation system is provided wherein the waste water is clarified and reused in the paper making process and the removed solid material may also be used in the paper making process either as a part of the paper pulp or as a part of the fuel supply. The ecological benefits of such a closed loop system for paper mill waste water are apparent.

In addition, the economic benefits to the paper mill are also great. For example, by recycling the clarified waste water, the amount of fresh make-up water required is greatly reduced. This not only saves on water costs, but permits a previously non-existent feasibility in choice of location for the mill site since huge supplies of fresh water are not required. Likewise, since it is possible to use the sludge produced as a fuel source, the fuel supply requirements are also reduced. Similarly, with recycling of clarified waste water the amount of time and money expended to meet the EPA requirements for that part dumped is greatly reduced. An even more significant economic advantage to the paper mill operator is that the present process of clarifying the waste water permits the use of cheaper grades of raw materials. This is because there is no concern for the amount or quality of waste water originally produced - all of it can be clarified by the instant process.

Accordingly, it is an object of the present invention to provide an effective process for clarifying paper mill waste water by addition of sulfuric acid to lower the pH to below 4, aging, and then adding calcium hydroxide to the waste water to raise the pH to above 10.

It is another object of the present invention to provide a process for recirculating paper mill waste water by clarifying the waste water and reusing it in the paper making process while at the same time making effective use of the solids separated from the clarified waste water.

Other objects and advantages of the present invention will be apparent from the following description, the accompanying drawing, and the appended claims.

BRIEF DESCRIPTION OF THE DRAWINGS

The FIGURE is a flow chart of the perferred process as utilized in a boxboard mill to clarify the waste water and reuse the neutralized, clarified waste water in the paper making process.

DESCRIPTION OF THE PREFERRED EMBODIMENT

As a preferred embodiment, the waste water from the various pulpings, refinings, deinkings, cleanings, dilutions, etc., involved in either a primary or secondary paper mill paper-making process are collected for treatment. In the figure, wherein a boxboard mill is shown as the illustrated paper-making process, the waste water is collected in line 12 from cleaner 14 and paper machine 16. It then is introduced into a mixer 18 which may, for example, be an in-line mixer of type commonly available. At this point sulfuric acid, as a concentrated (96%) liquid is added to and mixed with the waste water in a sufficient amount to lower the pH to below 4. For waste water at an approximately neutral pH (which is often the case), 320 parts/million by weight of concentrated $H_2SO_4$ will bring the pH to 4.0 or less.

Next, the waste water is, in the preferred embodiment, allowed to remain in contact with acid, for example in aging tank 20, for a sufficient amount of time to render insoluble some of the dissolved and emulsified solids. The time required is a function of temperature. Lower temperatures require longer times. Satisfactory results have been obtained at 100°-110° F. for periods of approximately 5 minutes. At room temperature, a minimum aging period can be established at the five minute mark. This may come about as a result of the time required for thorough mixing or it may be omitted altogether in a continuous treatment process. Likewise, longer aging times may be used without detriment since the only thing that happens is that some of the solids may begin to settle-out to an extent. To an extent this is desirable since in one embodiment of the present invention (not shown) a separation (i.e., filtration) step can be undertaken before addition of the alkaline material. However, even if there is no intermediate separation, when the alkaline material is added to the acidified waste water, remixing occurs sufficiently to bring all of the solids into contact with the alkaline material. The desired coagulation occurs with this contact.

The alkaline material used is preferably dry slaked lime ($Ca(OH)_2$). It is thoroughly mixed by mixer 22 with the acidified waste in order to bring the pH to 10 or above as rapidly as possible. Again mixer 22 may be an in-line mixer, a lightening-type mixer, or other known types of mixers used as dry feeders. On the basis of earlier addition of 320 parts/million of $H_2SO_4$ to an essentially neutral waste water, it requires approximately 250 parts/million by weight of slaked lime to raise the pH to 10 or more.

From mixer 22, the treated waste water may be pumped through a rotary vacuum filter 24 of the type well known in the industry. On addition of the lime, with very little residual time (less than two minutes), coagulation has occured to the extent that filtration is effective. Of course, other means of separation such as decanting, sedimentation, etc. may be used. But filtration is preferred since it permits immediate recycling of the filtrate via line 26 back into the paper making process (pulper 28, cleaner 14, etc.) after treatment of the waste water in the manner described.

Before this is done, however, it is desirable to add an acid, such as sulfuric acid, to the clarified waste water to bring the pH to approximately 7.0. This is done at station 30. Again on the basis of addition of the preferred amounts of acid and alkaline material as given above, approximately 120 parts/million by weight of concentrated $H_2SO_4$ would be required to return the clarified waste water to neutral.

Also as mentioned previously, it may be desirable to use chlorine as an alternative or additive to an acid at this stage to neutralize the pH and remove any color remaining in the clarified waste water. Finally, it is noted that the BOD of the waste water may not be acceptable for disposal, but does not affect its use as an input water in the paper making process itself. The small amount residual dissolved $CaSO_4$, not removed by filtration offers no objection since it is often added to paper pulp anyway.

The solids (sludge) separated from the clarified waste water can be handled in a number of ways. When filtration is used as the separation means, the filter cake typically might have the following composition: water - 70% by weight, fiber - 22% by weight, and ash (primarily $CaSO_4$) - 8% by weight. As such the solids, with its 22% fiber content, may find utility as a pulp source for low grade paper and may be reused in the paper-making process itself.

Alternatively, the sludge can be dewatered by any common means and then burned. For example, in the above indicated typical analysis, a ten pound sample would contain seven pounds of water, 2.2 pounds of fiber and 0.8 pounds of ash. It takes approximately 7000 BTU to evaporate seven pounds of water under standard conditions. On the other hand, 2.2 pounds of dry cellulose fiber has a heat value of approximately 17,600 BTU. Thus, after evaporating the water, approximately 10,000 BTU (1000 BTU/lb of sludge) is available as a power source. Most conveniently, the dewatered sludge may be burned in the power plant of the paper mill as a heat source. It is noted that when burned, the fly ash from such burning is high in clay and calcium sulfate content and, itself, finds utility as a filler material.

Even if these reuse possibilities are not feasible in a particular paper mill, the sludge separated from the clarified waste water may be used as a landfill. With a resultant 30% solids content, this represents a workable material which will support a sand or earth overfill. If the sludge dump pit has a sandy bottom in particular, loading over with a surfacing material is effective since the pressure completes the dewatering of the coagulated materials by displacing the water through the sandy bottom. The resultant landfill is a solid, tillable piece of earth.

EXAMPLE 1

Samples of waste water effluent were obtained from the Diamond International Board Mill in Cincinnati, Ohio. It was analyzed and found to have the following characteristics:

(1) The solids portion represents 0.2% by weight.
(2) The pH of the material is approximately 7 or neutral.
(3) After agitation the settling time for the majority of the solids is very long, i.e., it requires 48 hours for the solids to settle to the point that the solids layer represents approximately 15% of the total height. Even so, the solids density is very low (little more than water).
(4) After settling for 48 hours the liquid is still fairly murky. The estimated transmittance is 60%, as compared to 100% for pure $H_2O$.
(5) After agitation transmittance of the mixture is approximately 6%.
(6) There is murkiness and the waste water has the appearance of an emulsion.
(7) Centrifuging the mixture does not reduce the murkiness.
(8) Attempts to filter the mixture proved fruitless.

To a 100cc portion of the sample waste water, $H_2SO_4$ (3 drops 96% concentration) was added until the pH reached 1. After aging for five minutes at room temperature, the liquid was of improved clarity, but not 100% (approximately 80% transmittance). Dry $Ca(OH)_2$ (0.3 grams) was then added to bring the pH to 12. Upon addition of the $Ca(OH)_2$ floc formation began, the solids settled fairly rapidly (approximately 200 ml through a fast filter paper in approximately 10 seconds). The filtrate was observed to be crystal clear (transmittance 100%), although colored a very pale yellow. Addition of $H_2SO_4$ to neutralize the filtrate eliminated the yellow color.

The thus clarified water was determined to have characteristics making it acceptable for recycling to the stock preparation point of either a primary or secondary paper mill of the type mentioned.

EXAMPLE 2

A 1000 ml sample of waste water from Diamond International as in Example 1 was heated to 110° F and mixed with eight drops of concentrated $H_2SO_4$ to bring the pH to 2.8. After ten minutes of aging some large floc was noted at the top of the container, while some was at the bottom and there were fine particles in between. After thirty minutes with no change, 500 ml was decanted off. This liquid had a slight off color of very light smoke. To this 0.25 grams of dry $Ca(OH)_2$ was added and blended in to raise the pH to 10.6. There was a big flake coagulant formed. After fifteen minutes another decantation was conducted. The clarified waste water obtained was then treated first with $H_2SO_4$ (four drops) and then NaOH to bring the pH to 6.3. From a clarity and color standpoint, the clarified waste was optically clear and useable in the paper making process.

EXAMPLE 3

Samples of waste water effluent were obtained from Gulf State's kraft mill in Tuscaloosa, Alabama. A 1000 ml sample having a pH of approximately 7.2 was heated to 110° F and $H_2SO_4$ (five drops 96% concentrate) added to reduce the pH to 3.8. After aging for five minutes at the elevated temperature, dry $Ca(OH)_2$ (0.6 grams) was added and mixed in to bring the pH to 11.0. Settling began and flake formation was large. Aften ten minutes the supernatant was much clearer and after nineteen minutes, it was nearly clear. The 825 ml of clear supernatant was decanted off and treated with $H_2SO_4$ to bring the pH to 7.85 – 8.1. The liquid was clear, although it had a slight yellowish tint. This was removed with chlorine, making the clarified water completely acceptable as input water in either a primary or a secondary mill.

While the method herein described constitutes a preferred embodiment of the invention, it is to be understood that the invention is not limited to this precise method, and that changes may be made therein without departing from the scope of the invention.

What is claimed is:

1. In a paper-making process a method for treating paper mill waste water to remove the suspended material therein so that the clarified waste water may be reused in the paper-making process, comprising the steps of:
   (a) adding a sufficient amount of sulfuric acid to reduce the pH of the waste water to less than 4.0,
   (b) mixing thoroughly, then,
   (c) adding a sufficient amount of calcium hydroxide to rapidly drive the pH of the acidified waste water to above 10 and cause coagulation of the solid matter in said waste water,
   (d) separating the coagulated solid material from the waste water to clarify it, and
   (e) treating the clarified waste water to return the pH to approximately neutral.

2. The method of claim 1 wherein said sulfuric acid is added as a concentrated liquid and thoroughly mixed with said waste water and said calcium hydroxide is added as a dry slaked lime and thoroughly mixed with said acidified waste water.

3. The method of claim 2 wherein the acidified waste water is allowed to age for a period of time sufficient to permit a reaction to take place which renders insoluble some of the dissolved emulsified solids in said waste water.

4. The method of claim 3 wherein said sulfuric acid is added to a neutral pH waste water at the rate of 320 parts/million, said dry slaked lime is added at the rate of 250 parts/million, and said aging step is conducted at at least room temperature for over five minutes.

5. The method of claim 2 wherein said coagulated solid material is separated from said waste water by filtration.

6. The method of claim 5 wherein said solid material removed by filtration is further dewatered and, then, burned as a source of fuel for said paper making process.

7. The method of claim 5 wherein said solid material removed by filtration is used as a pulp source in the paper-making process.

8. The method of claim 7 wherein said paper making process is a boxboard producing process and said solid material removed by filtration is used as a pulp source for the filler section of the boxboard.

9. The method of claim 5 wherein said solid material is used as a landfill.

10. In a paper making process utilizing large quantities of water for stock preparation and the like, a method of providing the major part of water needed in such process by treatment and recycling of waste water therefrom comprising the steps of (a) continuously collecting waste water from the several steps of the paper-making process;
(b) passing the collected waste water through a first treatment stage and adding thereat sufficient sulfuric acid to reduce the pH of the mixture to at least 4.0;
(c) mixing thoroughly,
(d) then passing the acidified waste water through a second treatment stage and adding thereat sufficient calcium hydroxide to raise the pH of the mixture quickly to at least 10 causing coagulation of solids in the mixture;
(e) removing the coagulated solids from the mixture to clarify the waste water;
(f) restoring the pH of the clarified waste water approximately to neutral; and
(g) recycling the neutralized, clarified waste water into the paper-making process as the major source of water for that process.

* * * * *